United States Patent [19]

Herrera

[11] 4,013,227

[45] Mar. 22, 1977

[54] WELDING TORCH TIP AND METHOD

[76] Inventor: John T. Herrera, 4510 Shorehaven Lane, Racine, Wis. 53403

[22] Filed: Feb. 17, 1976

[21] Appl. No.: 658,177

Related U.S. Application Data

[63] Continuation-in-part of Ser. No. 605,911, Aug. 19, 1975, abandoned.

[52] U.S. Cl. ..... 239/291; 239/544; 239/567

[51] Int. Cl.[2] ..... F23D 23/00; B05B 1/14

[58] Field of Search ..... 239/1, 8, 11, 290, 291, 239/296, 413, 419, 422, 424–425, 427, 428, 430, 432, 433, 552, 553.3, 556, 561, 567, 590.3, 543, 544

[56] References Cited

UNITED STATES PATENTS

| | | | |
|---|---|---|---|
| 1,289,992 | 12/1918 | Willson | 239/553.3 |
| 1,408,194 | 2/1922 | Harris | 239/419 |
| 1,940,111 | 12/1933 | Austin | 239/413 X |
| 2,893,646 | 7/1959 | Batts | 239/433 X |
| 3,430,868 | 3/1969 | Berger | 239/590.3 |
| 3,439,997 | 4/1969 | Hancock et al. | 239/556 X |
| 3,873,028 | 3/1975 | Miller | 239/413 |

*Primary Examiner*—Johnny D. Cherry
*Assistant Examiner*—Andres Kashnikow
*Attorney, Agent, or Firm*—Arthur J. Hansmann

[57] ABSTRACT

A welding torch tip for use in welding ferrous metals with Mapp gas, and method for same. The tip is elongated and has threads in one end thereof and a gas outlet in the other end thereof and it has a gas mixing chamber centrally located in the tip and intermediate the screw threads and the outlet. The method is the steps of introducing the gas into the tip and mixing the gas in a chamber in the tip and then directing the gas through a passageway and out of the tip.

2 Claims, 5 Drawing Figures

WELDING TORCH TIP AND METHOD

This invention relates to a welding torch tip for use in welding ferrous metals with Mapp gas, and a method of controlling and mixing gases for welding ferrous metals. This is a continuation-in-part of U.S. patent application Ser. No. 605,911, filed Aug. 19, 1975, and now abandoned.

BACKGROUND OF THE INVENTION

Welding torch tips, and like tips, are already known in the prior art and they exist in many different configurations and for different purposes. In the present instance, the problem and concern is to be able to utilize Mapp gas for the purpose of welding ferrous metals. Heretofore the industry and prior art have not been knowledgeable in the use of Mapp gas for welding ferrous metals. Accordingly, it is the primary object of this invention to provide apparatus and a method for using Mapp gas in welding ferrous metals. Specifically, with regard to the apparatus of this invention, this invention provides a welding torch tip which can be used in place of a conventional tip and thus is used with other conventional welding equipment, and the tip of this invention is capable of receiving and dispensing Mapp gas which is therefore capable of welding ferrous metals, and the prior art welding tips are not capable, or at least are not as fully capable or as efficient in being employed in welding ferrous metals with Mapp gas. Similarly, this invention provides a method for controlling Mapp gas for welding ferrous metals.

Other objects and advantages will become apparent upon reading the following description in light of the accompanying drawings.

DETAILED DESCRIPTION OF THE PREFERRED EMBODIMENT AND METHOD

Figure 1:
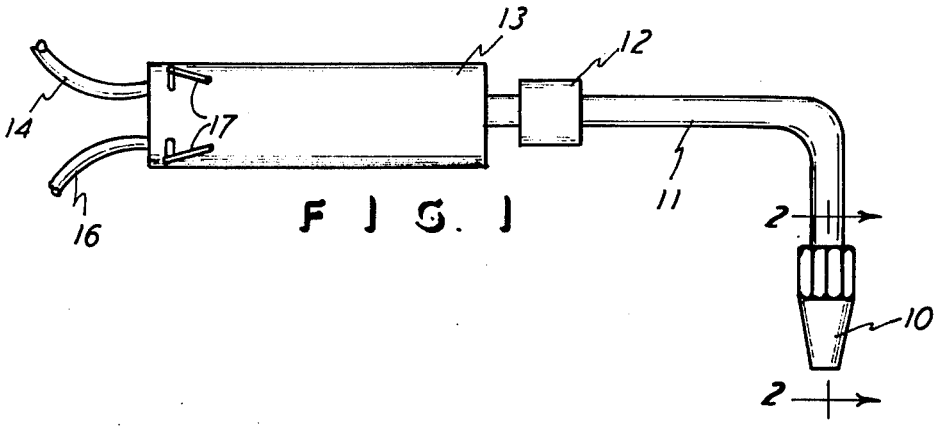
FIG. 1 is a side elevational view of welding equipment with the tip of this invention included therein.

The apparatus of this invention, which is the welding tip itself, is shown in the drawings and is hereinafter described, and, in conjunction with that description and in addition thereto, the method invention is herein fully disclosed. Also, the present invention is operative with the use of Mapp gas which is a gas containing methyl, acetylene, and propadyne with stabilizers. With the use of Mapp gas, welding of ferrous metals is much more economical than it is with the use of conventional welding gases, since Mapp gas uses only approximately one-eighth of the acetylene which is otherwise required and has been required by the prior art. Accordingly, FIG. 1 shows conventional welding equipment, except for the welding torch tip 10 which is provided by this invention and which is suitably threadedly attached to a pipe 11 which extends from a gas mixing member 12 interposed between the usual torch body or handle 13 which has the flexible conduits or gas lines 14 and 16 connected thereto. Thus, with the conventional arrangement and elements shown, the line 14 can be connected with a supply (not shown) of Mapp gas, and the line 16 can be connected with a supply (not shown) of oxygen, and both the lines 14 and 16 are connected to the torch handle or body 13, and each line is respectively under the control of valves 17, all in a conventional arrangement. Of course the gases in the lines 14 and 16 pass through the handle 13 and into the mixing chamber 12 where the gases are preliminarily mixed, and the gas then passes into the pipe 11, all in the conventional arrangement and method. Finally, the gas is passed into the welding torch tip 10 of this invention.

Figure 2:
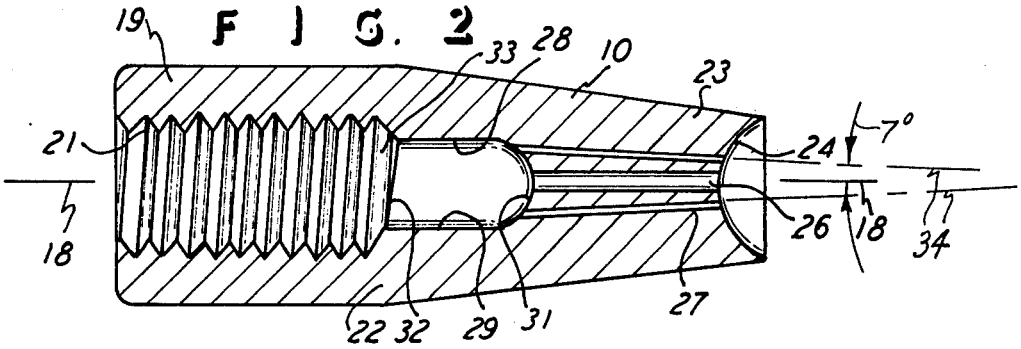
FIG. 2 is an enlarged sectional view taken along the line 2—2 of FIG. 1.
Figure 3:
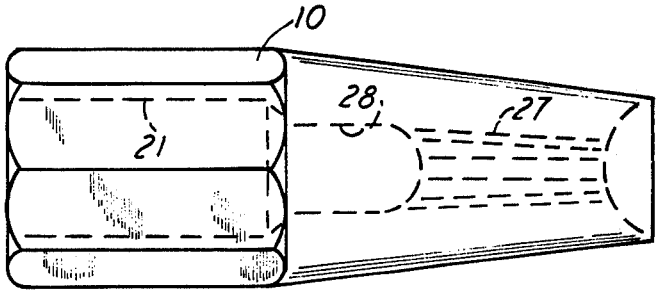
FIG. 3 is a side elevational view of the tip shown in FIG. 2.

FIG. 2 shows the tip 10 to be elongated and having a longitudinal axis extending from left to right, as viewed in FIGS. 2 and 3 and with the axis extending along the centerline designated 18. The tip 10 has one end 19 with screw threads 21 which extend through the end 19 and terminate at a central portion 22 of the tip 10. The tip 10 has its other end 23 terminating in a concave surface 24 which is the location of the exhausting of the gases from the tip 10 and thus the welding flame is produced adjacent the surface 24, for the purpose of welding ferrous metals with the Mapp gas disclosed herein.

Figure 4:
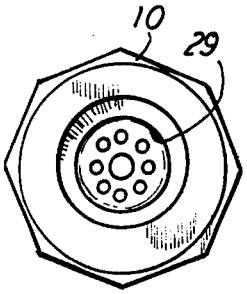
FIGS. 4 and 5 are left and right, respectively, end elevational views of the tip shown in FIG. 3.
Figure 5:
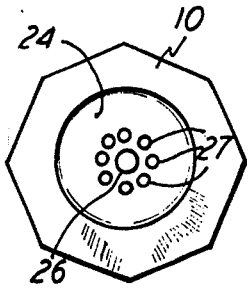

The tip end 23 has a primary gas passageway 26 which is elongated and extends on the tip axis 18, as shown. Also, the end 23 has a plurality of secondary gas passageways 27 which are equally spaced around the primary passageway 26, as seen in FIGS. 4 and 5. Thus the gases will flow through the passageways 26 and 27 for the purpose of effecting the flame for the welding function.

The particular feature of this invention is with regard to a chamber 28 in the tip central portion 22, and the chamber 28 is in gas flow communication with the screw threads 21 and the passageways 26 and 27. The chamber 28 is thus provided and is available for secondary mixing of the gases coming from the hoses 14 and 16, and by virtue of the provision of the chamber 28, the Mapp gas is useful and efficient in the welding of ferrous metals. The chamber 28 is defined by a cylindrical wall 29 and a concave end wall 31 which intersects the passageways 26 and 27, as shown in FIG. 2. Of course the chamber 28 has its end 32 in gas-flow communication with and open to the screw threads 21, as shown and described. Thus, the wall 31 is disposed transverse to the longitudinal axis 18 of the tip 10, and the wall therefore interrups the flow of the gases in their path to the surface 24. By the interruption of the flow as mentioned, the gases coming from the two lines 14 and 16 are therefore sufficiently mixed so that the Mapp gas is effective in the welding of ferrous metals.

With reference to FIG. 2, it will therefore be understood that the end of the pipe 11 would extend into the tip 10 to the location of the last screw thread 33, and the gas would therefore flow from the pipe 11 and into the secondary mixing chamber 28 and, as mentioned, the flow would then be interrupted by the chamber wall 31, and thus the secondary mixing occurs in the chamber 28.

Accordingly, the tip 10 is arranged with the combination of features of the size and location of the chamber 28, as shown in FIG. 2, and the tip 10 has the plurality of passageways 26 intersecting the wall 31 which is transverse to the flow of the gases through the tip 10, and finally the tip has the concave wall 24, all for guiding and directing the gases so that there is proper mixing of the gases and so that there is a soft and neutral type of flame suitable for welding ferrous metals. That is, without the features mentioned, the Mapp gas is not suitable for welding ferrous metals, and the proper mixture, both in quantities and quality of mix between the oxygen and the Mapp gas are achieved to avoid an oxide film-forming flame on the weld puddle, which film does result when the conventional tip is used. Further, the concave end 24 in combination with the passageways 26 and 27 and the chamber 28 directs the gas and controls the flame to provide the desired concentrated heat for welding mentioned. FIG. 2 also shows that the cross-sectional size of the passageway 26 is larger than the cross-sectional size of the individual passageways 27, and the surrounding passageways 27 provide a shield against atmospheric oxidation of the flame.

The aforementioned therefore discloses the construction of the tip itself, and it also discloses the method of utilizing Mapp gas for welding ferrous metals wherein the gases are directed into the tip and into the mixing chamber 28 where the flow is interrupted, by the gases encountering the wall 31, and the gases are then thoroughly mixed and are directed through the outlet passageways 26 and 27, for the purpose of providing the welding flame. Also, in this arrangement, it will be seen that the wall 31 is of a semicircular shape and the chamber cylindrical wall 29 is tangential with the end wall 31, and the diameter of the cylindrical wall 29 is substantially the same as the smaller diameter of the screw thread 21.

The drawings also show that the passageways 27 are in fluid-flow communication between the walls 31 and 24 and the longitudinal directions or axes of the passageways 27 are directed at an angle relative to the longitudinal axes of the passageway 26, that is along the line designated 18—18. The passageways 27 therefore are oriented to be angled inwardly and toward the outlet end of the passageway 26 at the concaved surface 24, and the angle is actually preferred to be between 5° and 7°, as shown by the axis lines designated 34 which are the longitudinal axes of the passageways 27 and which therefore have the 5° to 7° angle relative to the line 18—18. As mentioned, this angle of 5° to 7° exists in all of the eight passageways 27 relative to the main passageway 26.

Accordingly, the eight passageways 27 are provided to enable the Mapp flame to penetrate the atmospheric oxide film on the surface of the metal being worked upon, for instance. With the main passageway 26 supplying the gas mixture for supporting the flame adjacent the surface 24, the eight surrounding passageways 27 are directed inwardly toward the flame, and the gas flowing through the passageways 27 provides a heat shield from this atmospheric oxidation mentioned. The 5° to 7° angle for the passageways 27 is oriented and aimed to concentrate the heat on the same target as that for the main jet flame supported through the passageway 26 and in conjunction with the concaved surface 24, all to produce a quick and direct and clean weld puddle.

Accordingly, the orientation of the longitudinal axes of the eight passageways 27 is such that the axes are slightly radially directed relative to the concave surface 24, as seen in FIG. 2.

What is claimed is:

1. A welding torch tip for use in welding ferrous metals with Mapp gas, comprising an elongated body for attachment to a supply line which conducts the gas to the tip, said body having a gas-flow passageway extending through one end thereof and having an outlet end and extending along the longitudinal axis of said one end for the flow of the gas from the tip, said body having a chamber disposed in gas-flow communication with said passageway and being located on said longitudinal axis and of a cross-sectional size greater than the cross-sectional size of said passageway, for guiding the gas to flow through said body, said chamber being shaped to present an end wall of a concave shape extending transversely to the longitudinal axis of said passageway and with the center of the concave shape intersecting said passageway for mixing of the gases flowing through said body, said body having a concave end surface intersecting the gas outlet end of said passageway for directing the gases along the longitudinal axis of said one end, said body having a plurality of additional gas-flow passageways extending therein adjacent and spaced around the first said passageway and being in gas-flow communication with said chamber from said end wall for the flow of the gases from the tip, said additional gas-flow passageways aligned to intersect said concave end surface at locations spaced from the first said passageway at said end surface and having the longitudinal axes of said additional gas-flow passageways being angled inwardly and toward the longitudinal axis of the first said passageway.

2. The welding torch tip for use in welding ferrous metals with Mapp gas as claimed in claim 1, wherein said angle of said additional gas-flow passageways is between 5° and 7° relative to the said longitudinal axis of the first said passageway, for directing the gas toward the flame supported by the first said passageway and for surrounding said flame with additional gas and thereby guard against atmospheric oxidation.

* * * * *